US010667045B1

(12) United States Patent
Xiong et al.

(10) Patent No.: US 10,667,045 B1
(45) Date of Patent: May 26, 2020

(54) ROBOT AND AUTO DATA PROCESSING METHOD THEREOF

(71) Applicant: UBTECH ROBOTICS CORP LTD, Shenzhen (CN)

(72) Inventors: Youjun Xiong, Shenzhen (CN); Fanglin Xing, Shenzhen (CN)

(73) Assignee: UBTECH ROBOTICS CORP LTD, Shenzhen (CN)

( * ) Notice: Subject to any disclaimer, the term of this patent is extended or adjusted under 35 U.S.C. 154(b) by 0 days.

(21) Appl. No.: 16/447,986

(22) Filed: Jun. 21, 2019

(30) Foreign Application Priority Data

Dec. 28, 2018 (CN) ..... 2018 1 1620508

(51) Int. Cl.
*H04R 1/40* (2006.01)
*H04R 1/02* (2006.01)

(52) U.S. Cl.
CPC ..... *H04R 1/406* (2013.01); *H04R 1/028* (2013.01)

(58) Field of Classification Search
CPC ..... H04R 1/406; H04R 1/028; G10L 2021/02166
USPC ..... 381/91–92
See application file for complete search history.

(56) References Cited

U.S. PATENT DOCUMENTS

2005/0058300 A1* 3/2005 Suzuki ..... H04R 1/406 381/92
2010/0150364 A1* 6/2010 Buck ..... G01S 3/807 381/66
2017/0243577 A1* 8/2017 Wingate ..... H04R 3/00
2018/0374494 A1* 12/2018 Yamaya ..... G10L 21/028
2019/0104360 A1* 4/2019 Bou Daher ..... H04R 3/005
2019/0250245 A1* 8/2019 Koyama ..... G01S 5/28
2019/0364375 A1* 11/2019 Soto ..... G10L 15/22

FOREIGN PATENT DOCUMENTS

JP 2007-221300 A 8/2007
JP 2007-241157 A 9/2007
JP 2008-278399 A 11/2008
JP 2011-069901 A 4/2011

* cited by examiner

*Primary Examiner* — Disler Paul

(57) ABSTRACT

The present disclosure provides a robot and an audio data processing method thereof. The robot includes a body part, a main control module, and a sound pickup module electrically coupled to the main control module. The sound pickup module includes N microphones distributed around the body part to collect audio data. The main control module is configured to obtain the audio data of a sound source from a part of the N microphones collecting the audio data of the sound source without blocked by the body part, and perform a sound source localization and a sound pickup based on the obtained audio data. The 360-degree wake-up and sound source localization of the robot and the beam-forming of directional beams are realized. In addition, the sound pickup is realized without forming microphone holes on the head of the robot, hence the aesthetics of the robot will not be affected.

14 Claims, 4 Drawing Sheets

ROBOT AND AUTO DATA PROCESSING METHOD THEREOF

CROSS REFERENCE TO RELATED APPLICATIONS

This application claims priority to Chinese Patent Application No. CN201811620508.6, filed Dec. 28, 2018, which is hereby incorporated by reference herein as if set forth in its entirety.

BACKGROUND

1. Technical Field

The present disclosure relates to intelligent robot technology, and particularly to a robot and an audio data processing method thereof.

2. Description of Related Art

When designing a robot, if the position of a microphone array is not arranged correctly, the voice interaction will be affected. Because the most basic requirement and prerequisite for the beam-forming of the microphone array is that sounds should directly reach each microphone in the microphone array. Therefore, if an annular microphone array is disposed at the neck of the robot, the neck of the robot will hide the microphones behind the neck, which causes the sounds to be reflected by the neck and can not directly reach the microphone behind the neck of the robot, thus affecting the effect of sound pickup.

In order to resolve the above-mentioned problems, it is generally to place an annular microphone array on the head of the robot, or to use an annular microphone array and a linear microphone array at the same time, where the annular microphone array is disposed at the neck of the robot for realizing the 360-degree wake-up and 360-degree sound source localization of the robot, and the linear microphone array is disposed on the head of the robot for beam-forming so as to perform sound pickup.

However, disposing the annular microphone array on the head of the robot will cause a limit to the height of the robot. At the same time, since the annular microphone array needs to be kept horizontally and statically so as to achieve a better effect of sound pickup, which causes a limit to the movement of the head of the robot, and the openings for the microphone which are disposed annularly on the head of the robot also affects the aesthetics of the robot. In addition, the simultaneous use of the annular microphone array and the linear microphone array will cause that there is full of holes in the body of the robot, which causes poor noise reduction while affects the aesthetics of the robot.

BRIEF DESCRIPTION OF THE DRAWINGS

To describe the technical schemes in the embodiments of the present disclosure more clearly, the following briefly introduces the drawings required for describing the embodiments or the prior art. Apparently, the drawings in the following description merely show some examples of the present disclosure. For those skilled in the art, other drawings can be obtained according to the drawings without creative efforts.

DETAILED DESCRIPTION

In the following descriptions, for purposes of explanation instead of limitation, specific details such as particular system architecture and technique are set forth in order to provide a thorough understanding of embodiments of the present disclosure. However, it will be apparent to those skilled in the art that the present disclosure may be implemented in other embodiments that are less specific of these details. In other instances, detailed descriptions of well-known systems, devices, circuits, and methods are omitted so as not to obscure the description of the present disclosure with unnecessary detail.

It is to be understood that, the term "includes" and any of its variations in the specification and the claims of the present disclosure are intended to cover a non-exclusive inclusion. For example, a process, method, system, product or device including a series of steps or units is not limited to the steps or units listed, but optionally also includes steps or units not listed, or alternatively also includes other steps or units inherent to the process, method, product or device. Furthermore, the terms "first", "second", "third" and the like are used to distinguish different objects, and are not intended to describe a particular order.

In order to solve the problem that the height of the robot and the movement of the head of the robot are limited as well as being unsightly due to the improper disposition of the annular microphone array, the present disclosure provides a robot and an audio data processing method thereof. By disposing an annular and evenly distributed N microphones on a body part of the robot to collect audio data, transmitting the collected N channels of audio data and reference audio data to a main control module of the robot, and realizing a sound source localization and a sound pickup based on the audio data through the main control module, which can support the 360-degree wake-up and sound source localization of the robot, and can support the beam-forming of directional beams. Which realizes the sound pickup without causing limitation on the height of the robot, and the movement of the head of the robot will not be limited.

For the purpose of describing the technical solutions of the present disclosure, the following describes through specific embodiments.

Embodiment 1

Figure 1:
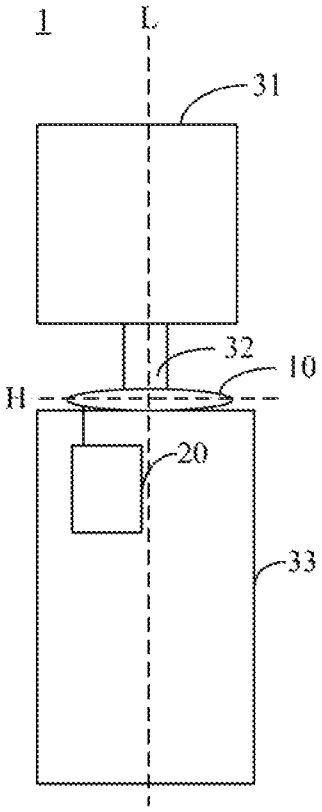
FIG. 1 is a schematic block diagram of a robot according to embodiment 1 of present disclosure.

FIG. 1 is a schematic block diagram of a robot according to embodiment 1 of present disclosure. As shown in FIG. 1, in this embodiment, a robot 1 is provided. The robot 1 includes a sound pickup module 10, a main control module 20, and body parts (of a body of the robot 1) which include a head 31, a neck 32, and a trunk 33. In other embodiments, the body parts may further include a waist, limb(s), and the like.

The sound pickup module 10 is electrically coupled to the main control module 20. The sound pickup module 10 includes a microphone array 11 (see FIG. 3). The microphone array 11 includes N microphones, where $N \geq 3$ and N is an integer.

In this embodiment, the N microphones of the microphone array 11 are evenly distributed around each of the body parts, which are configured to collect audio data from a sound source S (see FIG. 3) such as a user of the robot 1. In addition, the N microphones of the microphone array 11 in the sound pickup module 10 are distributed around the neck 32. In other embodiments, the N microphones of the microphone array 11 can be distributed around each of the body parts in a non-even manner, and the N microphones of the microphone array 11 can be distributed around the head 31, the trunk 33, or two or more of the body parts of the robot 1. The main control module 20 is configured to obtain the audio data of the sound source S from a part of the N microphones in the microphone array 10 which collects the audio data of the sound source S without blocked (i.e., shielded) by the body part, and perform a sound source localization and a sound pickup based on the obtained audio data. In which, the sound source localization is for locating the sound source S, and the sound pickup is for picking up the sound of the sound source S.

Figure 2:
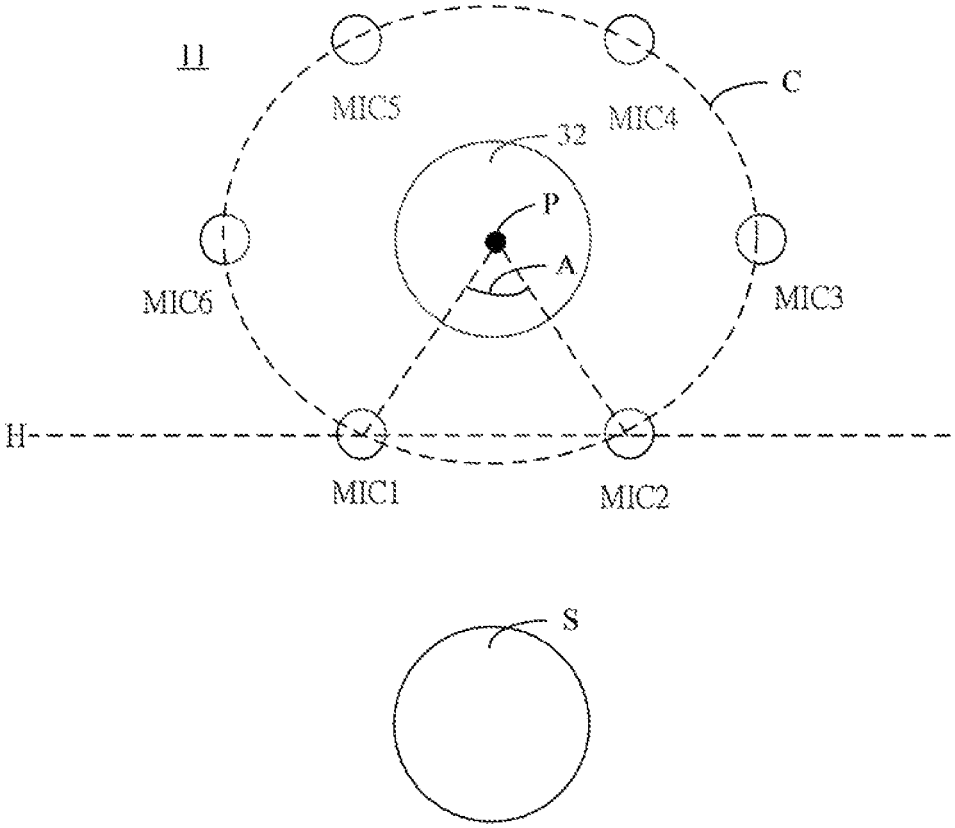
FIG. 2 is a schematic block diagram of a microphone array 11 of the robot of FIG. 1.

FIG. 2 is a schematic block diagram of the microphone array 11 of the robot 1 of FIG. 1. As shown in FIG. 2, in this embodiment, the microphone array 11 includes a first microphone MIC1, a second microphone MIC2, a third microphone MIC3, a fourth microphone MIC4, a fifth microphone MIC5, and a sixth microphone MIC6, where the first microphone MIC1 and the second microphone MIC2 are located on a horizontal line H perpendicular to a longitudinal axis L (see FIG. 1) of the trunk 33, and each adjacent two of the first microphone MIC1, the second microphone MIC2, the third microphone MIC3, the fourth microphone MIC4, the fifth microphone MIC5, and the sixth microphone MIC6 have the same spacing and form an included angle A of 60 degrees with respect to a center P of a circumference C which is centered on any point on the longitudinal axis L of the trunk 33, that is, the microphones are evenly distributed around the neck 32 of the robot 1 at 360 degrees. The first microphone MIC1, the second microphone MIC2, the third microphone MIC3, the fourth microphone MIC4, the fifth microphone MIC5, and the sixth microphone MIC6 constitute the microphone array 11 which is the annular microphone array 11 with six microphones which surround the neck 32 of the robot 1. In other embodiments, the horizontal line H can be not perpendicular to the longitudinal axis L, and the microphones can be distributed around the neck 32 in a non-even manner.

It should be noted that, a part of the N microphones which the voice of the sound source S can reach directly (i.e., reach without blocked) are used to realize the beam-forming. In this embodiment, since the annular microphone array with six microphones is used, a semi-circular microphone array composed of all the microphones in the annular microphone array which the voice of the sound source S can reach directly will not be blocked (by the neck 32) when collecting the audio data. Therefore, the audio data collected by the semi-circular microphone array composed of the first microphone MIC1, the second microphone MIC2, the third microphone MIC3, and the sixth microphone MIC6 is used to perform the beam-forming so as to achieve a better effect of sound pickup. In other embodiments, the audio data collected by another microphone array composed of a part of the above-mentioned microphones and/or the other microphones in the annular microphone array can be used to perform the beam-forming, as long as the voice of the sound source S can directly reach all the microphones in the microphone array. In addition, another annular microphone array having different amount of microphones and/or having the microphones disposed in other manners can be used.

Figure 3:
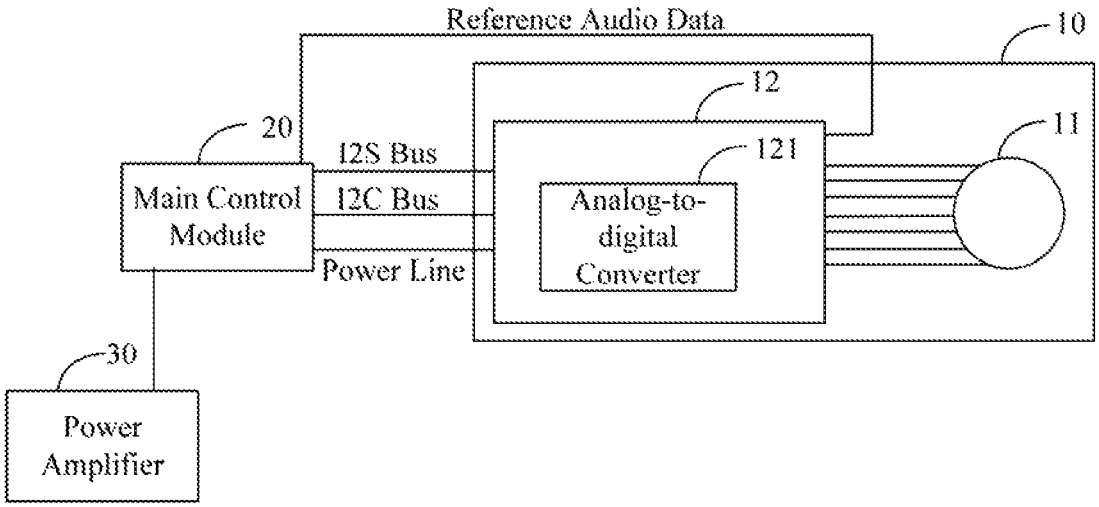
FIG. 3 is a schematic block diagram of a sound pickup module 10 of the robot of FIG. 1.

In one embodiment, the sound pickup module 10 further includes a MIC small board 12 (see FIG. 3). The MIC small board 12 is electrically coupled to each of the microphone array 11 and the main control module 20. The MIC small board 12 is configured to perform an analog-to-digital conversion on the N channels of audio data collected by the microphone array 11 and transmit the converted audio data to the main control module 20. In this embodiment, the MIC small board 12 converts the N channels of the analog audio data collected by the microphone array 11 into digital audio data, and then transmits the digital audio data to the main control module 20.

In one embodiment, the MIC small board 12 includes an analog-to-digital converter 121 electrically coupled to each of the microphone array 11 and the main control module 20. The analog-to-digital conversion is performed on the N channels of audio data through the analog-to-digital converter 121.

In one embodiment, the MIC small board 12 is capable of converting the analog audio data collected by each microphone into corresponding digital audio data, then numbering the digital audio data, and then transmitting the numbered digital audio data to the main control module 20.

FIG. 3 is a schematic block diagram of the sound pickup module 10 of the robot 1 of FIG. 1. As shown in FIG. 2, in one embodiment, the sound pickup module 10 includes the MIC small board 12 which is electrically coupled to the microphone array 11 through a microphone wire, where the MIC small board 12 includes the analog-to-digital converter 121. The MIC small board 12 is electrically coupled to the main control module 20 through an 12S bus, an 12C bus, and a power line. The MIC small board 12 is configured to perform an analog-to-digital conversion on the N channels of audio data which are collected by the microphone array 11 through the analog-to-digital converter 121, fuses the converted N channels of audio data, and transmits the fused audio data to the main control module 20 through an 12S interface. The MIC small board 12 also numbers the N channels of audio data, respectively, so that the audio data is associated with the microphone which collected the audio data by numbering.

In one embodiment, the microphone array 11 includes six microphones, where the six microphones are disposed on the trunk 33 of the robot 1. Specifically, the six microphones are distributed on a circumference centered on any point on the longitudinal axis L (see FIG. 1) of the trunk 33, where the circumference is perpendicular to the longitudinal axis L. In other embodiments, the microphone array 11 may include another amount of microphones which is equal to or larger than three.

In this embodiment, the robot 1 is a humanoid robot which includes the head 31, the neck 32, and the trunk 33, and the six microphones are disposed at the neck 32.

In one embodiment, the robot 1 further includes a power amplifier 30 electrically coupled to the main control module 20. The main control module 20 is configured to generate X channels of reference audio data based on audio data obtained from the power amplifier 30 to transmit to the MIC small board 12. The MIC small board 12 is further configured to perform an analog-to-digital conversion on the X channels of reference audio data, encode the converted X channels of reference audio data, and transmit the encoded X channels of reference audio data to the main control module 20. In one embodiment, the X channels of reference audio data is transmitted to the MIC small board 12 through the main control module 20, and the input X channels of reference audio data is numbered and fused with the N channels of audio data by the MIC small board 12 to transmit to the main control module 20 through the 12S interface. The main control module 20 eliminates echoes based on the X channels of reference audio data, filters out the influence of the environmental noise, and further improves the accuracy of the sound source localization and the voice recognition.

The main control module 20 is further configured to obtain the audio data played by the power amplifier 30 and generate the X channels of reference audio data based on the audio data played by the power amplifier 30.

In one embodiment, if the played audio data obtained by the main control module 20 has dual channels, two channels of reference audio data are generated; if the played audio data obtained by the main control module 20 has mono channel, one channel of reference audio data is generated; and if the played audio data obtained by the main control module 20 has four channels, four channels of reference audio data are generated. Taking the dual channels' reference audio data as an example, the main control module 20 will be electrically coupled to the MIC small board 12 directly through data line(s), and then transmits the two channels of reference audio data played by the power amplifier 30 of the main control module 20 to the MIC small board 12. In which, the amount of the data line(s) corresponds to the amount of the channels of the reference audio data, such that each channel uses one data line.

In one embodiment, the main control module 20 includes a data buffer pool 21 configured to store the N channels of audio data. In other embodiments, the buffer pool 21 may store not only the N channels of audio data, but also the X channels of reference audio data received from the MIC board 12.

In one embodiment, the main control module 20 stores the N channels of audio data and the reference audio data which are obtained from the 12S interface of the MIC small board 12 in the data buffer pool 21. The main control module 20 performs data multiplexing on the audio data in the data buffer pool 21, and realizes a 360-degree wake-up and a beam-forming by executing a predetermined algorithm so as to perform sound pickup. It should be noted that, the above-mentioned predetermined algorithm may include an existing localization algorithm for performing sound source localization based on the collected audio data, an existing wake-up algorithm for waking up the robot based on the collected audio data, and an existing beam-forming and sound pickup algorithm for performing the beam-forming and the sound pickup based on the collected audio data.

In one embodiment, the robot wake-up is performed by using the corresponding audio data collected by the annular microphone array with six microphones and the two channels of reference audio data (a total of eight channels of audio data), that is, the sound source localization is performed based on the above-mentioned eight channels of audio data, and an angle difference between a sound source position and a current position is determined through the sound source localization. The robot 1 is controlled to turn according to the angle difference and then waked up. After waking up the robot 1, the beam-forming, the sound pickup, and the voice recognition are performed on the audio data collected by the first microphone MIC1, the second microphone MIC2, the third microphone MIC3, and the sixth microphone MIC6 in the annular microphone array with six microphones and the two channels of reference audio data (a total of six channels of audio data), that is, audio data for voice recognition is obtained after performing the noise reduction and the echo cancellation on the above-mentioned six channels of audio data. After recognizing the audio data by an audio recognizing unit, the audio data is converted to texts.

In one embodiment, the main control module 20 may be an Android development board, and a data buffer pool is configured in the software layer of the Android development board. The N channels of audio data and the two channels of reference audio data which are transmitted by the sound pickup module 10 are numbered and stored in the above-mentioned data buffer pool, and the required audio data is obtained from the data buffer pool in parallel by performing the wake-up algorithm and a recognition algorithm in parallel. It should be noted that, the above-mentioned wake-up algorithm may be various existing voice wake-up algorithms, and the above-mentioned recognition algorithm may be various existing voice recognition algorithms. By multiplexing the audio data collected by the microphones, the audio data obtained by a part of the microphones is used by both the wake-up algorithm and the recognition algorithm. In such a manner, the microphone array positioned at the neck 21 of the robot 1 can still achieve the 360-degree sound source localization and the 360-degree wake-up, while ensuring the collection (i.e., the beam-forming and the sound pickup) of audio data for voice recognition, which does not affect voice recognition. In addition, there is also no need to form microphone holes on the head 31 of the robot 1, hence the aesthetics of the robot 1 will not be affected.

In this embodiment, a robot is provided. By disposing an annular and evenly distributed N microphones on a body part of the robot to collect audio data, transmitting the collected N channels of audio data to a main control module of the robot, and realizing a sound source localization and a sound pickup based on the audio data through the main control module, which can support the 360-degree wake-up and sound source localization of the robot, and can support the beam-forming of directional beams. Which realizes the sound pickup without causing limitation on the height of the robot, and the movement of the head of the robot will not be limited, which resolves the existing problems that the height of the robot and the movement of the head of the robot are limited as well as being unsightly due to the position of disposing the annular microphone array.

Embodiment 2

Figure 4:
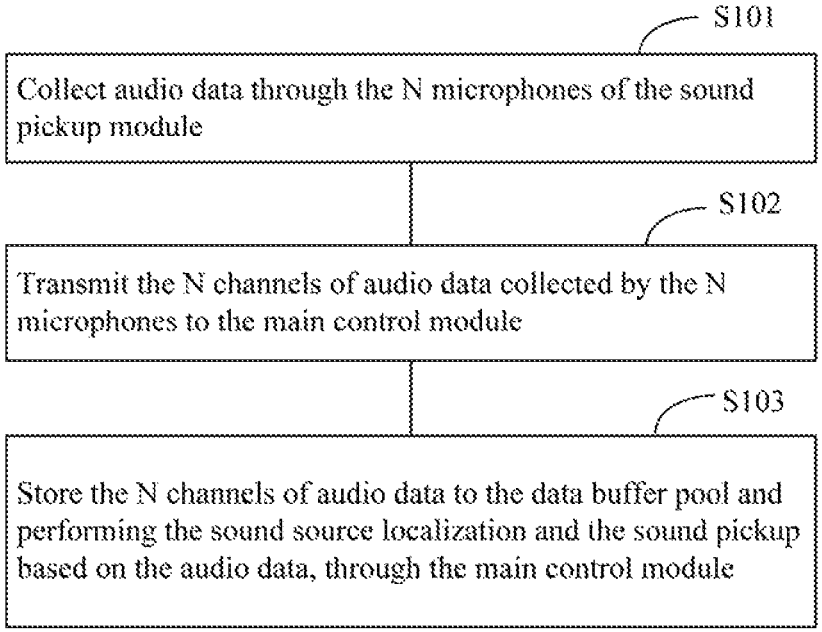
FIG. 4 is a flow chart of an audio data processing method based on the robot of FIG. 1 according to embodiment 2 of present disclosure.

FIG. 4 is a flow chart of an audio data processing method based on the robot of FIG. 1 according to embodiment 2 of present disclosure. In this embodiment, an audio data processing method is provided. The method is a computer-implemented method executable for a processor of the robot as shown in FIG. 1 or through a storage medium. As shown in FIG. 4, the method includes the following steps.

S101: collecting audio data through the N microphones of the sound pickup module.

In one embodiment, the audio data is collected through the N microphones disposed at the trunk 33 of the robot 1. The N microphones are distributed on the circumference C centered on any point P on the longitudinal axis L of the trunk 33, where the circumference C is perpendicular to the longitudinal axis L, $N \geq 3$ and N is an integer. In other embodiments, the circumference C can be not perpendicular to the longitudinal axis, which can have an included angle such as an angle of 15 degrees or 30 degrees with respect to the longitudinal axis L, where the included angle can be adjusted according to the algorithms to be used.

In one embodiment, the N microphones are six microphones, where the six microphones are disposed on the neck 21 of the robot 1. In which, the six microphones are distributed on the circumference C centered on any point P on the longitudinal axis L of the trunk 33 of the robot 1, where the circumference C is perpendicular to the longitudinal axis L, and the six microphones form an annular microphones array with six microphones.

S102: transmitting the N channels of audio data collected by the N microphones to the main control module.

In one embodiment, the N channels of audio data collected by the N microphones is transmitted to the main control module 20, so as to realize the sound source localization and the sound pickup based on the above-mentioned audio data through the main control module 20.

In one embodiment, through the MIC small board 42 electrically coupled to the N microphones of the microphone array 11, after performing the analog-to-digital conversion on the N channels of audio data, the data fusion is performed on the analog-to-digital converted audio data, and then the fused audio data is transmitted to the main control module 20.

In one embodiment, when the MIC small board 42 performs the data fusion, the reference audio data is received to fuse with the N channels of audio data, and the fused audio data is transmitted to the main control module 20.

In one embodiment, the MIC small board 42 also numbers each channel of the audio data, which numbers the N channels of audio data and the two channels of reference audio data, respectively.

S103: storing the N channels of audio data to the data buffer pool and performing the sound source localization and the sound pickup based on the audio data, through the main control module.

In one embodiment, the main control module 20 executes a corresponding algorithm based on the audio data stored in the data buffer pool 21 to perform the sound source localization and he sound pickup so as to realize the wake-up and the voice recognition. Specifically, the main control module 20 obtains the audio data of the corresponding number from the data buffer pool 21 according to the algorithm to be executed, and executes the corresponding algorithm.

In one embodiment, the main control module 20 obtains the N channels of audio data and the two channels of reference audio data from the data buffer pool 21, and executes the wake-up algorithm based on the N channels of audio data and the two channels of reference audio data to realizes the 360-degree wake-up of the robot 1. The main control module 20 obtains the audio data collected by the first microphone MIC1, the audio data collected by the second microphone MIC2, and the two channels of reference audio data from the data buffer pool 21 in parallel, and executes a voice recognition algorithm based on the audio data collected by the first microphone MIC1, the audio data collected by the second microphone MIC2, the audio data collected by the third microphone MIC3, the audio data collected by the sixth microphone MIC6, and the two channels of reference audio data to realize voice recognition on the words spoken by the user.

In one embodiment, the above-mentioned step S103 may include the following steps.

S1031: storing two channels of the reference audio data and the N channels of audio data to the data buffer pool.

S1032: obtaining a first group of the audio data from the data buffer pool to use a first predetermined algorithm to locate the sound source S.

S1033: obtaining a second group of the audio data from the data buffer pool to use a second predetermined algorithm to perform a beam-forming and an audio noise reduction.

In one embodiment, the above-mentioned N channels of audio data is six channels of audio data.

In one embodiment, the audio data collected by each microphone is numbered correspondingly, that is, the audio data obtained by a first microphone in the microphones arrays is taken as first audio data, the audio data obtained by a second microphone in the microphones arrays is taken as second audio data, the audio data obtained by a third microphone in the microphones arrays is taken as third audio data, the audio data obtained by a fourth microphone in the microphones arrays is taken as fourth audio data, the audio data obtained by a fifth microphone in the microphones arrays is taken as fifth audio data, the audio data obtained by a sixth microphone in the microphones arrays is taken as sixth audio data, a first channel reference audio data in the two channels of reference audio data is taken as seventh audio data, and a second channel reference audio data in the two channels of reference audio data is taken as eighth audio data. The above-mentioned first group of the audio data includes the first audio data, the second audio data, the third audio data, the fourth audio data, the fifth audio data, the sixth audio data, the seventh audio data, and the eighth audio data; and the above-mentioned second group of the audio data includes the first audio data, the second audio data, the third audio data, the sixth audio data, the seventh audio data, and the eighth audio data.

In one embodiment, the echo cancellation, the 360-degree sound source localization and the robot wake-up are performed by using the corresponding audio data collected by the annular microphone array with six microphones and the two channels of reference audio data (a total of eight channels of audio data), that is, the echo cancellation and the sound source localization are performed based on the first audio data, the second audio data, the third audio data, and the fourth audio data, the fifth audio data, the sixth audio data, the seventh audio data, and the eighth audio data, and an angle difference between a sound source position and a current position is determined through the sound source localization. The robot is controlled to turn according to the angle difference and then waked up. After waking up the robot, the echo cancellation, the noise reduction, the beam-forming, the sound pickup, and the voice recognition are performed based on the audio data collected by the first microphone MIC1, the audio data collected by the second microphone MIC2, the audio data collected by the third microphone MIC3, the audio data collected by the sixth microphone MIC6, and the two channels of reference audio data (a total of six channels of audio data), that is, audio data for voice recognition is obtained after performing the noise reduction and the echo cancellation on the first audio data, the second audio data, the third audio data, the sixth audio data, the seventh audio data, and the eighth audio data. After recognizing the audio data by an audio recognizing unit, the audio data is converted to texts, so as to realize the voice recognition.

It should be noted that, the above-mentioned first predetermined algorithm may be an existing wake-up algorithm capable of realizing the sound source localization and the robot wake-up, and the second predetermined algorithm may be an existing algorithm capable of realizing the voice recognition.

In this embodiment, an audio data processing method based on the robot of embodiment 1 is provided. Similarly, by disposing an annular and evenly distributed N microphones on a body part of the robot to collect audio data, transmitting the collected N channels of audio data to a main control module of the robot, and realizing a sound source localization and a sound pickup based on the audio data through the main control module, which can support the 360-degree wake-up and sound source localization of the robot, and can support the beam-forming of directional beams. Which realizes the sound pickup without causing limitation on the height of the robot, and the movement of the head of the robot will not be limited, which resolves the existing problems that the height of the robot and the movement of the head of the robot are limited as well as being unsightly due to the position of disposing the annular microphone array.

The above-mentioned embodiments are merely intended for describing but not for limiting the technical schemes of the present disclosure. Although the present disclosure is described in detail with reference to the above-mentioned embodiments, it should be understood by those skilled in the art that, the technical schemes in each of the above-mentioned embodiments may still be modified, or some of the technical features may be equivalently replaced, while these modifications or replacements do not make the essence of the corresponding technical schemes depart from the spirit and scope of the technical schemes of each of the embodiments of the present disclosure, and should be included within the scope of the present disclosure.

What is claimed is:

1. A robot, comprising:

at least one body part;

a main control module comprising a data buffer pool; and a sound pickup module electrically coupled to the main control module, wherein the sound pickup module comprises N microphones distributed around the body part to collect audio data, where N≥3 and N is an integer, and wherein when collecting the audio data, a part of the N microphones is capable of receiving a direct sound from a sound source, but the rest part of the N microphones is incapable of receiving the direct sound but reflect sounds of the sound source;

wherein, the main control module is configured to obtain first audio data of the sound source collected by the N microphones, perform a sound source localization based on the first audio data, obtain second audio data of the sound source collected by the part of the N microphones which is capable of receiving the direct sound, and perform a sound pickup and a voice recognition based on the second audio data;

wherein, the main control module is further configured to store X channels of reference audio data and N channels of audio data to the data buffer pool, obtain a first group of the audio data from the data buffer pool as the first audio data of the sound source collected by the N microphones, to use a first predetermined algorithm to locate a sound source, and obtain a second group of the audio data from the data buffer pool as the second audio data of the sound source collected by the part of the N microphones which is capable of receiving the direct sound, to use a second predetermined algorithm to perform a beam-forming and an audio noise reduction;

wherein the N channels of audio data is six channels of audio data, and the X channels of reference audio data is two channels of reference audio data;

wherein, audio data obtained by a first microphone in microphones arrays is taken as first audio data, audio data obtained by a second microphone in the microphones arrays is taken as second audio data, audio data obtained by a third microphone in the microphones arrays is taken as third audio data, audio data obtained by a fourth microphone in the microphones arrays is taken as fourth audio data, audio data obtained by a fifth microphone in the microphones arrays is taken as fifth audio data, audio data obtained by a sixth microphone in the microphones arrays is taken as sixth audio data, first channel reference audio data in the two channels of the reference audio data is taken as seventh audio data, and second channel reference audio data in the two channels of the reference audio data is taken as eighth audio data;

wherein, the first group of the audio data comprises the first audio data, the second audio data, the third audio data, the fourth audio data, the fifth audio data, the sixth audio data, the seventh audio data, and the eighth audio data; and wherein, the second group of the audio data comprises the first audio data, the second audio data, the third audio data, the sixth audio data, the seventh audio data, and the eighth audio data.

2. The robot of claim 1, wherein the sound pickup module further comprises:

a MIC small board electrically coupled to each of the microphone array and the main control module, wherein the MIC small board is coupled to perform an analog-to-digital conversion on the N channels of audio data collected by the microphones, encode the converted audio data, and transmit the encoded audio data to the main control module.

3. The robot of claim 2, wherein the MIC small board comprises:

an analog-to-digital converter electrically coupled to the microphone arrays and the main control module, wherein the analog-to-digital converter performs the analog-to-digital conversion on the N channels of audio data.

4. The robot of claim 2, further comprising:

a power amplifier electrically coupled to the main control module;

wherein the main control module is configured to generate the X channels of reference audio data based on audio data obtained from the power amplifier to transmit to the MIC small board, and the MIC small board is further configured to perform an analog-to-digital conversion on the X channels of reference audio data, encode the converted X channels of reference audio data, and transmit the encoded X channels of reference audio data to the main control module.

5. The robot of claim 4, wherein, the main control module is further configured to obtain the audio data played by the power amplifier and generate the X channels of reference audio data based on the audio data played by the power amplifier.

6. The robot of claim 5, wherein, number of the X channels of reference audio data is same as number of channels of the audio data played by the power amplifier, the main control module is electrically coupled to the MIC small board directly through data lines, and amount of the data lines corresponds to amount of the X channels of the reference audio data.

7. The robot of claim 5, wherein, the MIC small board is further configured to perform a data fusion, fuse received reference audio data with the N channels of audio data, and transmit fused audio data to the main control module.

8. The robot of claim 1, wherein the body part is a neck, the microphone array comprises six microphones, the six microphones are disposed around the neck and are distributed on a circumference centered on any point on a longitudinal axis of the body part.

9. The robot of claim 1, wherein the body part comprises at least one of neck and a trunk.

10. The robot of claim 1, wherein the main control module is further configured to determine an angle difference between a sound source position and a current position through the sound source localization, control the robot to turn according to the angle difference, wake up the robot, and perform the sound pickup and the voice recognition based on the second audio data of the sound source collected by the part of the N microphones which is capable of receiving the direct sound.

11. The robot of claim 1, wherein the at least one body part includes a head, a neck, and a trunk, and the N microphones are distributed around each of the at least one body part in a non-even manner, or, the N microphones are distributed around the head, the trunk, or two or more of the at least one body part.

12. The robot of claim 1, wherein the main control module is a development board, and the data buffer pool is configured in a software layer of the development board.

13. A computer-implemented audio data processing method based on a robot comprising: at least one body part; a main control module; and a sound pickup module electrically coupled to the main control module, wherein the sound pickup module comprises N microphones distributed around the body part to collect audio data, where N≥3 and N is an integer, and wherein when collecting the audio data, a part of the N microphones is capable of receiving a direct sound from a sound source, but the rest part of the N microphones is incapable of receiving the direct sound but reflect sounds of the sound source; wherein, the main control module is configured to obtain first audio data of the sound source collected by the N microphones, perform a sound source localization based on the first audio data, obtain second audio data of the sound source collected by the part of the N microphones which is capable of receiving the direct sound, and perform a sound pickup and a voice recognition based on the second audio data;

the method comprising executing on a processor of the robot the steps of:

collecting audio data through the N microphones of the sound pickup module;

transmitting the N channels of audio data collected by the N microphones to the main control module;

storing, by the main control module, the N channels of audio data to a data buffer pool; and performing, by the main control module, the sound source localization and the sound pickup based on the audio data;

wherein the step of storing, by the main control module, the N channels of audio data to the data buffer pool and the step of performing, by the main control module, the sound source localization and the sound pickup based on the audio data further comprise:

storing X channels of reference audio data and the N channels of audio data to the data buffer pool;

obtaining a first group of the audio data from the data buffer pool as the first audio data of the sound source collected by the N microphones, to use a first predetermined algorithm to locate a sound source; and obtaining a second group of the audio data from the data buffer pool as the second audio data of the sound source collected by the part of the N microphones which is capable of receiving the direct sound, to use a second predetermined algorithm to perform a beam-forming and an audio noise reduction;

wherein the N channels of audio data is six channels of audio data, and the X channels of reference audio data is two channels of reference audio data;

wherein, audio data obtained by a first microphone in microphones arrays is taken as first audio data, audio data obtained by a second microphone in the microphones arrays is taken as second audio data, audio data obtained by a third microphone in the microphones arrays is taken as third audio data, audio data obtained by a fourth microphone in the microphones arrays is taken as fourth audio data, audio data obtained by a fifth microphone in the microphones arrays is taken as fifth audio data, audio data obtained by a sixth microphone in the microphones arrays is taken as sixth audio data, first channel reference audio data in the two channels of reference audio data is taken as seventh audio data, and second channel reference audio data in the two channels of reference audio data is taken as eighth audio data;

wherein, the first group of the audio data comprises the first audio data, the second audio data, the third audio data, the fourth audio data, the fifth audio data, the sixth audio data, the seventh audio data, and the eighth audio data; and wherein, the second group of the audio data comprises the first audio data, the second audio data, the third audio data, the sixth audio data, the seventh audio data, and the eighth audio data.

14. The method of claim 13, wherein, the main control module determines an angle difference between a sound source position and a current position through the sound source localization, control the robot to turn according to the angle difference, wake up the robot, and perform the sound pickup and the voice recognition based on the second audio data of the sound source collected by the part of the N microphones which is capable of receiving the direct sound.

* * * * *